US012459627B2

(12) United States Patent
Kuroi

(10) Patent No.: US 12,459,627 B2
(45) Date of Patent: Nov. 4, 2025

(54) STEERING HANDLE DEVICE FOR VESSEL

(71) Applicant: NHK SPRING CO., LTD., Yokohama (JP)

(72) Inventor: Shigeru Kuroi, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 605 days.

(21) Appl. No.: 17/887,478

(22) Filed: Aug. 14, 2022

(65) Prior Publication Data

US 2023/0054975 A1 Feb. 23, 2023

(30) Foreign Application Priority Data

Aug. 17, 2021 (JP) ..... 2021-132754

(51) Int. Cl.
*B63H 25/02* (2006.01)

(52) U.S. Cl.
CPC ..... *B63H 25/02* (2013.01); *B63H 2025/022* (2013.01)

(58) Field of Classification Search
CPC ..... B63H 25/02; B63H 2025/022
See application file for complete search history.

(56) References Cited

U.S. PATENT DOCUMENTS 5,056,450 A * 10/1991 Mardikian ..... B63B 34/10 114/144 R
5,520,133 A * 5/1996 Wiegert ..... B63B 34/10 440/38
6,055,922 A * 5/2000 Madachi ..... B63H 21/213 114/144 R
6,105,528 A * 8/2000 Kuroi ..... B63H 21/213 114/154
6,202,584 B1 * 3/2001 Madachi ..... B63H 25/10 114/144 R (Continued)

FOREIGN PATENT DOCUMENTS

JP H01122396 U 8/1989
JP H02169388 A 6/1990

(Continued)

OTHER PUBLICATIONS

Japanese Office Action (and an English language translation thereof) dated Feb. 4, 2025, issued in counterpart Japanese Application No. 2021-132754.

*Primary Examiner* — S. Joseph Morano
*Assistant Examiner* — Jovon E Hayes
(74) *Attorney, Agent, or Firm* — Holtz, Holtz & Volek PC

(57) ABSTRACT

A steering handle device includes a housing to be mounted on a hull, a tube member and a steering shaft. The tube member is rotatable in a forward/backward direction around the tilt shaft relative to the housing. The steering shaft is inserted to the tube member. A steering arm is attached to the steering shaft. The steering arm includes an extending portion extending to an outer side of the housing. A joint member is provided on the extending portion. The joint member includes a connection portion to connect to the steering cable and a support portion to support the connection portion. When the steering shaft is in the neutral position in the rotation direction, the connection portion is located in a position corresponding to the tilt shaft as viewing the housing from the lateral direction.

4 Claims, 8 Drawing Sheets

(56) References Cited

U.S. PATENT DOCUMENTS

| | | | | |
|---|---|---|---|---|
| 6,959,661 | B2 * | 11/2005 | Nakajima | B63B 34/10 114/144 R |
| 7,216,600 | B1 * | 5/2007 | Hamilton | B63B 34/60 441/65 |
| 8,037,781 | B2 * | 10/2011 | Curtin | B63H 25/02 280/775 |
| 11,685,474 | B2 * | 6/2023 | Howard-Willis | B63B 1/248 440/29 |

FOREIGN PATENT DOCUMENTS

| | | | | |
|---|---|---|---|---|
| JP | H11348888 | A * | 6/1998 | B63H 21/213 |
| JP | H10236393 | A | 9/1998 | |
| JP | 4620973 | B2 | 11/2010 | |
| KR | 100414600 | B1 | 4/2004 | |

* cited by examiner

STEERING HANDLE DEVICE FOR VESSEL

CROSS-REFERENCE TO RELATED APPLICATIONS

This application is based upon and claims the benefit of priority from prior Japanese Patent Application No. 2021-132754 filed Aug. 17, 2021, the entire contents of which are incorporated herein by reference.

BACKGROUND OF THE INVENTION

1. Field of the Invention

The present invention relates to a steering handle device for small-sized vessels such as personal watercrafts, and in particular to a steering handle device including a tilt mechanism.

2. Description of the Related Art

Steering handle devices employed in personal watercrafts (P.W.C.) has a steering shaft which supports a handlebar. A steering arm is provided in a lower end of the steering shaft, and one end of a steering cable is connected to the steering arm. The other end of the steering cable is connected to a water jet nozzle in a rear part of the hull. When the handlebar is turned to the right or left, the steering arm is rotated, thus pushing or pulling the steering cable. Thus, the direction of the water jet nozzle is changed.

In the steering handle devices, a handle device with a tilt mechanism has been proposed. The tilt mechanism is used to change the tilt angle of the steering shaft according to the physique and preference of the operator. For example, JP H11-348888 A (Patent Literature 1), JP 10-236393 A (Patent Literature 2), JP 4620973 B (Patent Literature 3), etc., each discusses an examples of steering handle devices comprising a tilt mechanism.

The steering shaft of the steering handle device described in Patent Literature 1 includes an upper shaft portion on an upper side, a lower shaft portion on a lower side and a universal joint. The universal joint is provided between the upper shaft portion and the lower shaft portion. The steering shaft with the universal joint tilts only the upper shaft portion forward and backward when changing the tilt angle. The upper shaft portion is inserted to a tube member which can rotate back and forth with respect to the housing. The upper shaft portion is rotatably supported by the tube member around an axis extending along the vertical direction. The lower shaft portion is rotatably supported by the housing. The steering arm is attached to a lower end of the lower shaft portion. When the handlebar is rotated, the upper shaft portion and the lower shaft portion rotate together via the universal joint, and the steering arm rotates.

The steering shaft of the steering handle device described in Patent Literature 1 has a short span of the support portion for supporting the upper shaft portion. Therefore, there has been room for improvement in increasing the support strength of the steering shaft. In the embodiments provided in FIGS. 1 to 11 of Patent Literature 2 as well, it is difficult to increase the span of the support portion of the steering shaft because the steering shaft is divided into an upper part and a lower part.

The steering shaft described in Patent Literature 3 is not divided along the axial direction. Therefore, the span of the support portion can be increased. However, when the tilt angle of the steering shaft is changed, the lower part of the steering shaft moves forward and backward. The lower part of the steering shaft is provided with a steering arm, to which the steering cable is connected.

With this structure, in the steering shaft of Patent Literature 3, the steering cable moves (swings) when the tilt angle of the steering shaft changes. Therefore, it is necessary to arrange the steering cable in its range of motion so as not to interfere with surrounding parts. Here, there has been room for improvement in terms of layout restrictions with regard to the steering arm and the steering cable. The embodiment shown in FIG. 12 of Patent Literature 2 also has a drawback that the steering cable swings when the tilt angle of the steering shaft changes.

An object of the present invention is to provide a steering handle device which can suppress swinging near the joint portion between the steering arm and the steering cable even when the tilt angle changes, and also suppress the span of the support portion which supports the steering shaft from becoming smaller.

BRIEF SUMMARY OF THE INVENTION

According co one embodiment the present invention, there is provided a steering handle device comprising a housing fixed to a hull, a tube member and a steering shaft inserted to the tube member, a steering arm provided on a lower end of the steering shaft, and a joint member provided on the steering arm. A space for accommodating the tube member is formed inside the housing. The tube member is inserted to the space of the housing and supported by a tilt shaft having a horizontal first axis rotatably back and forth with respect to the housing. The joint member may be a part separate from the steering arm, or the joint member and the steering arm may be integrated to each other as one body.

The steering shaft includes a handlebar in an upper portion thereof. The steering shaft has a second axis extending in a length direction of the steering shaft. The steering shaft is rotatable about the second axis with respect to the tube member. The steering arm includes an extending portion extending toward an outer side of the housing. The joint member includes a connection portion to which a joint mechanism of a steering cable is connected. The joint member includes a support portion which support, when the steering shaft is in a neutral position in a direction rotation, the connection portion in a position corresponding to the tilt shaft.

According to the steering handle device of this embodiment, even if the tube member rotates in the forward/backward direction according to the tilt angle, it is possible to suppress the part of the steering cable, which is near the joint mechanism from swinging. Thus, it is possible to avoids the steering cable from interfering with other members, which allows a greater degree of freedom in laying out the steering arm and steering cable.

An example of the connection portion of the joint member includes a part which is a rotationally symmetric shape of a spherical surface. The connection portion is placed in a range in which the tilt shaft is extended in a direction along the first axis in a state where the steering shaft is in a neutral position in the rotation direction.

The side wall portion of the housing may include an offset wall portion which shifts a position of the tilt shaft in a forward/backward direction with respect to the second axis as viewed from a lateral direction of the housing. The offset wall portion is formed between the second axis and the tilt shaft as viewed from a lateral direction of the housing.

In the steering handle device according to the embodiment, the housing includes a flange portion on a lower portion thereof. The flange portion may be fixed to a mount surface on an outer side of a hull in a state where the housing, the tube member, the steering shaft, the steering arm, and the joint member are each positioned on an outer side of the hull.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A steering handle device according to one embodiment will be now described with reference to FIGS. 1 to 9.

Figure 1:
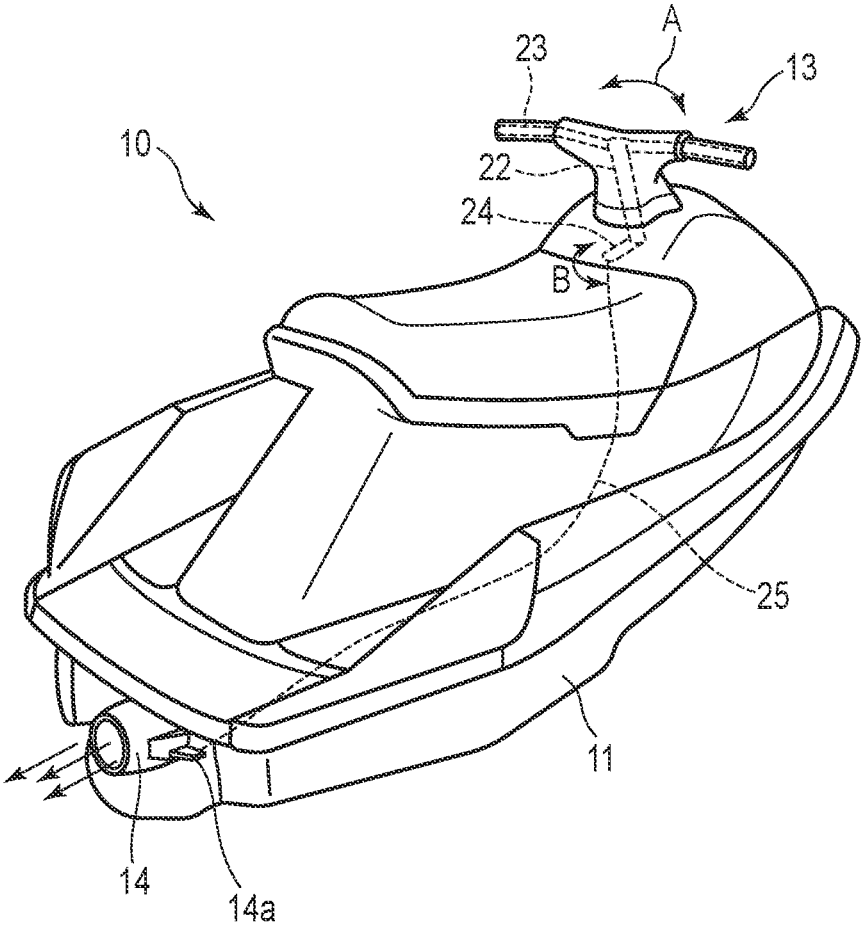
FIG. 1 is a perspective view showing a personal watercraft, which is an example of small vessels.
Figure 2:
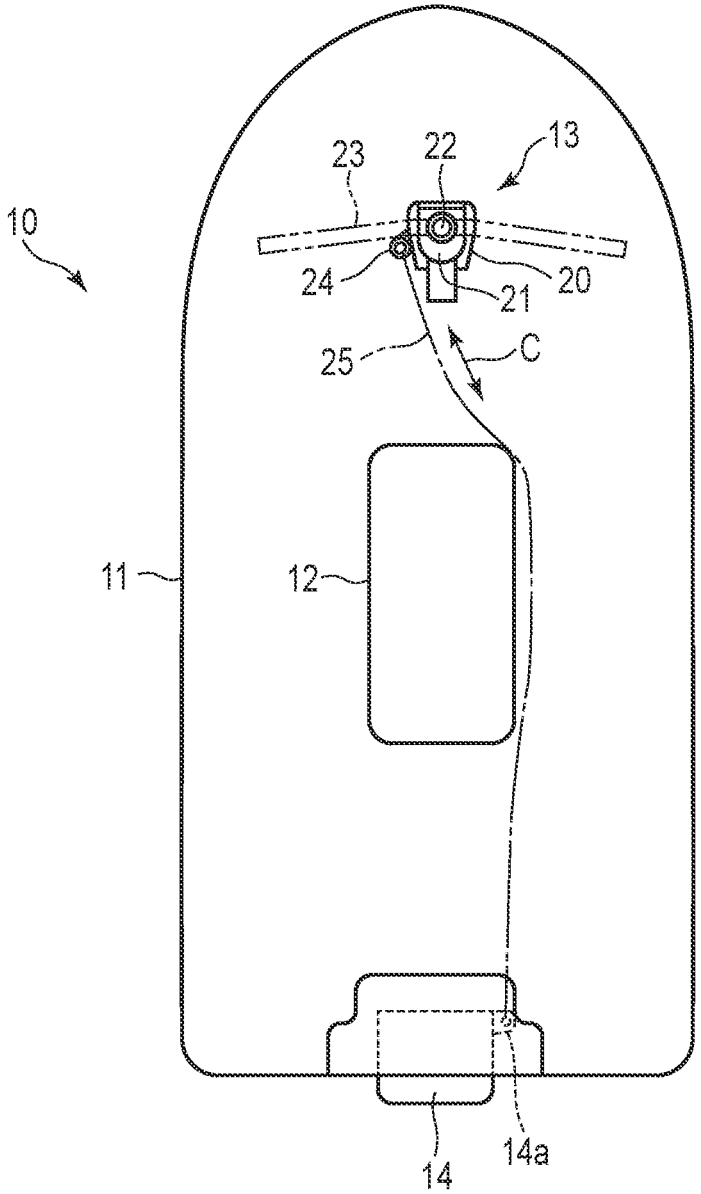
FIG. 2 is a plan view schematically showing a personal watercraft including a steering handle device according to one embodiment.

FIG. 1 shows a personal watercraft(, which may be referred to as a water motorbike) 10 as an example of small vessels. FIG. 2 is a plan view schematically showing the personal watercraft 10. The personal watercraft 10 includes a hull 11, an engine 12 installed in the hull 11, a steering handle device 13 located in a front portion of the hull 11, and a water jet nozzle 14 located in a rear portion of the hull 11.

The steering handle device 13 includes a housing 20 fixated to an outer side of the hull 11, a tube member 21, and a steering shaft 22 and the like, as will be described in detail later. In an upper portion of the steering shaft 22, a handlebar 23 is attached. In a lower end of the steering shaft 22, a steering arm 24 is provided. To the steering arm 24, one end of a steering cable (push-pull cable) 25 is connected. The other end of the steering cable 25 is connected to a operating portion 14*a* of the water injection nozzle 14.

The steering cable 25 is located between the water jet nozzle 14 and the steering arm 24 along a side surface of the engine 12 and the like. When the handlebar 23 is rotated in the direction indicated by A in FIG. 1, the steering arm 24 is rotated in the direction indicated by B. As the steering arm 24 is rotated, the steering cable 25 moves in the direction indicated by C in FIG. 2, which causes the water jet nozzle 14 changes its direction.

Figure 3:
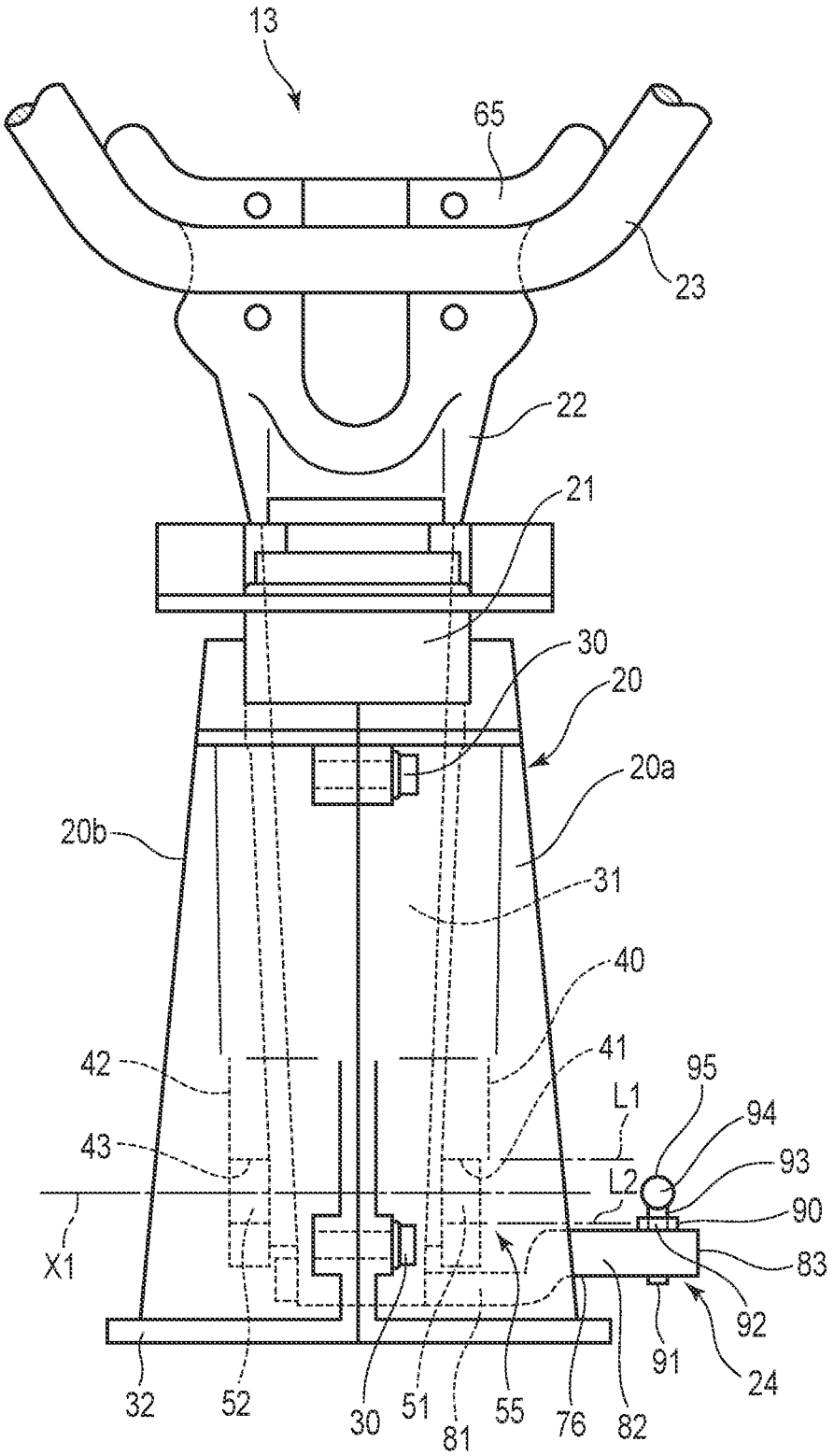
FIG. 3 is a front view of the steering handle device shown in FIG. 2, viewed from the front of the vessel.
Figure 4:
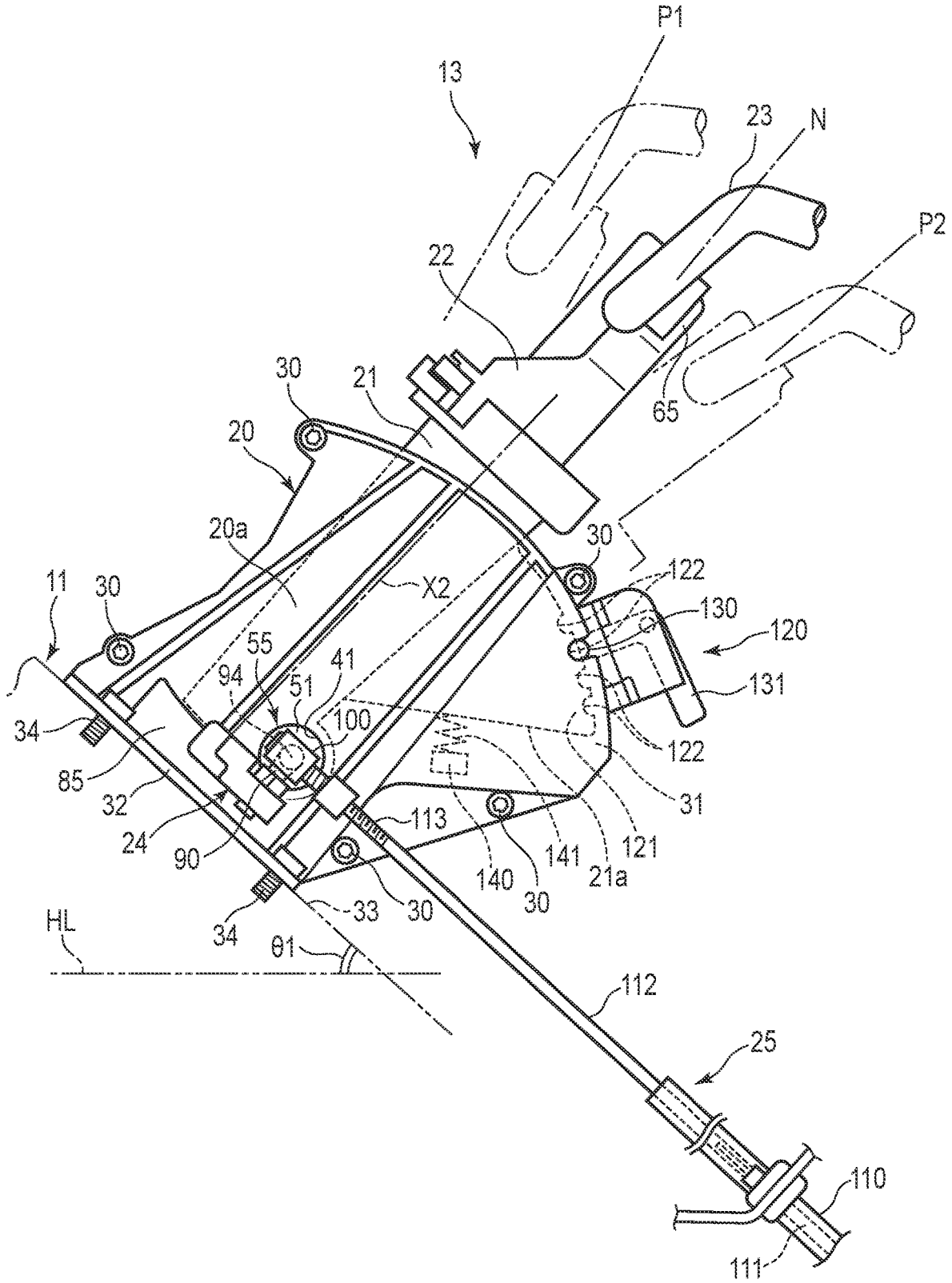
FIG. 4 is a side view of the steering handle device.
Figure 5:
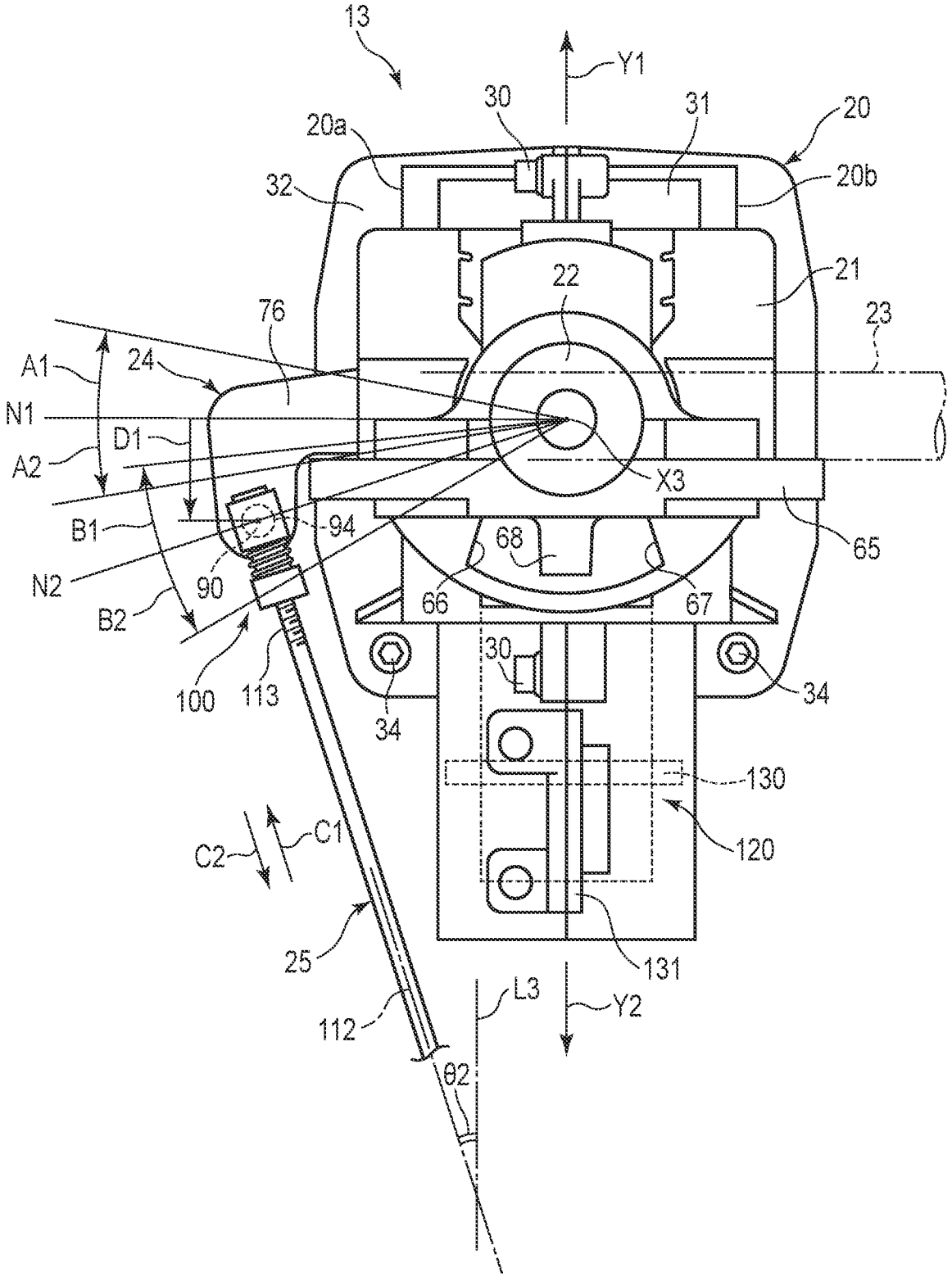
FIG. 5 is a plan view of the steering handle device.
Figure 6:
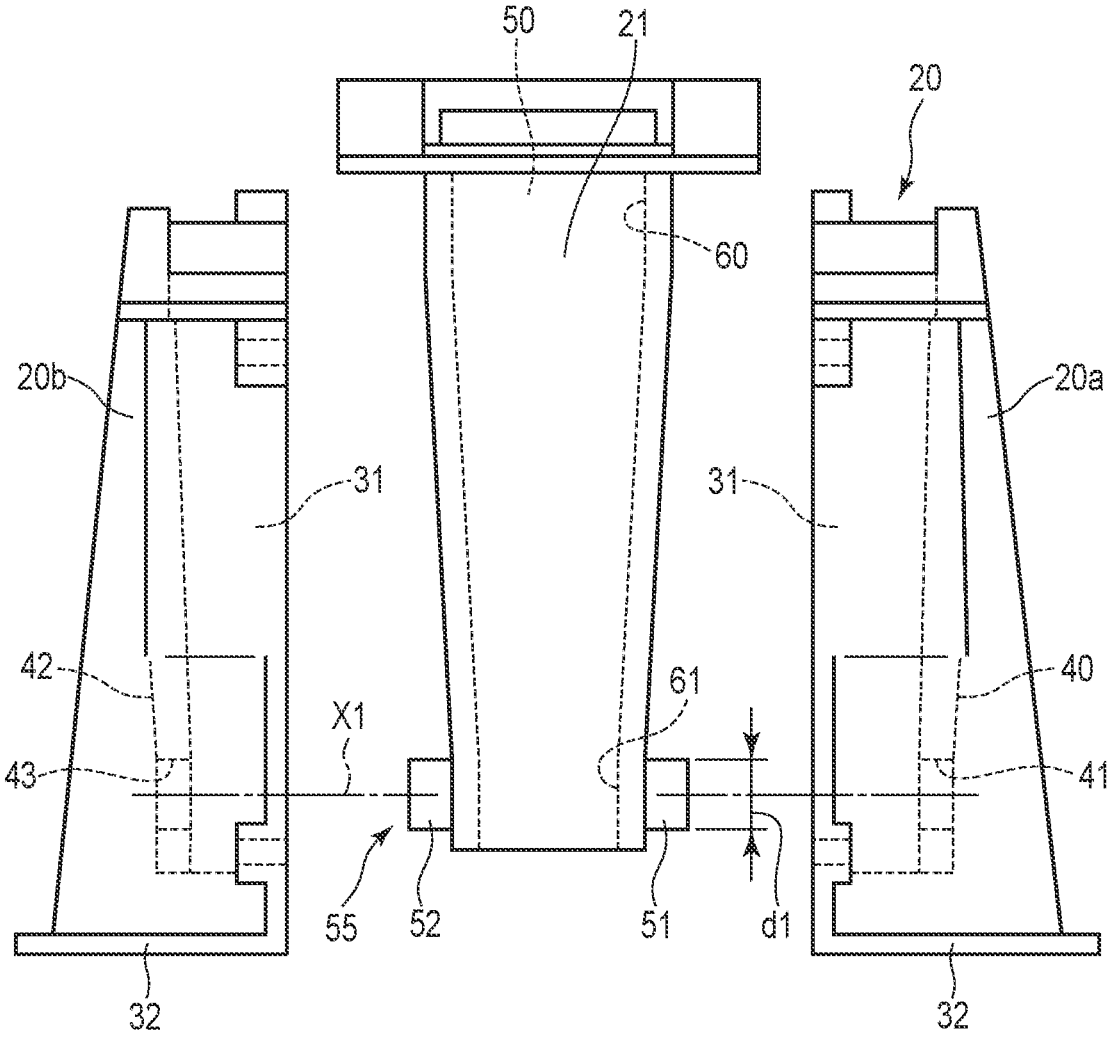
FIG. 6 is a front view of a housing and a tube member disassembled from the steering handle device.

FIG. 3 is a front view of the steering handle device 13 viewed from diagonally above the front of the null 11. FIG. 4 is a side view of the steering handle device 13 and FIG. 5 is a plan view of the steering handle device 13. In FIG. 5, an arrow Y1 indicates the front of the hull 11 and an arrow Y2 indicates the rear of the hull 11. FIG. 6 is a front view of the housing 20 and tube member 21 in a disassembled form.

As shown in FIGS. 3 and 6, the housing 20 comprises a pair of housing elements 20*a* and 20*b*, one on a left side and the other on a right side. The housing elements 20*a*, 20*b* are connected to each other by a coupling member 30 such as a bolt. An example of the material of the housing elements 20*a* and 20*b* is a metal such as an aluminum alloy, but it may as well be a non-metal such as a fiber-reinforced plastic.

Inside the housing 20, a space 31 is formed to accommodate the tube member 21 inserted thereto. At a lower portion of the housing 20, a flange 32 is provided. As shown in FIG. 4, the housing 20 is disposed on an outer side of a mount surface 33 of the hull 11 by a securing member 34 such as a bolt. The mount surface 33 is arranged at an angle θ1 with respect to a horizontal plane HL.

As shown in FIG. 6, a bearing hole 41 is formed in a side wall portion 40 of one housing element 20*a*. In a side wall portion 42 of the other housing element 20*b*, a bearing hole 43 is also formed. The bearing holes 41 and 43 are circular as viewed from a lateral direction of the housing 20 and are formed at respective positions opposing each other.

To the space 31 of the housing 20, a tube member 21 is inserted. The tube member 21 is made of synthetic resin or metal. On an inner side of the tube member 21, a shaft insertion hole 50 is formed, to which a steering shaft 22 is inserted. The shaft insertion hole 50 extends vertically over the entire length of the tube member 21. The cross section of the shaft insertion hole 50 is circular.

On a lower portion of the tube member 21, a pair of short cylindrical shaft portions 51 and 52 are formed. The shaft portions 51 and 52 protrude along the horizontal direction (along the width direction of the hull 11) from respective sides of the lower portion of the tube member 21. One shaft portion 51 is rotatably inserted into one bearing hole 41. The other shaft portion 52 is rotatably inserted into the other bearing hole 43.

The bearing holes 41 and 43 and the shaft portions 51 and 52 inserted respectively to the bearing holes 41 and 43 constitute a tilt shaft 55. The diameter of the tilt shaft 55 is defined by an outer diameter dl of the shaft portions 51 and 52 (shown in FIG. 6). The tilt shaft 55 supports the tube member 21 so as to be rotatable. As shown in FIGS. 3 and 6, the tilt shaft 55 has a first axis X1. The first axis X1 extends along the width direction of the hull 11 in the lower portion of the housing 20. When the tilt angle is changed, the tube member 21 is rotated back and forth around the first axis X1 with respect to the housing 20.

The steering shaft 22 is inserted to the shaft insertion hole 50 of the tube member 21. The steering shaft 22 has a second axis X2 (shown in FIG. 7) extending along the longitudinal direction. The tube member 21 includes an upper support 60 on an upper side and a lower support 61 on a lower side as shown in FIG. 6. The steering shaft 22 is rotatably supported by the upper support 60 and the lower support 61 around the second axis X2. The second axis X2 is also the center of rotation of the steering shaft 22.

The steering shaft 22 is formed from a single rod-shaped member extending in a direction along the second axis X2. The steering shaft 22 is therefore substantially rigid over its entire length. On an upper portion of the steering shaft 22, a handle mount portion 65 is provided to installing a handlebar 23. The steering shaft 22 and the handlebar 23 may be integrated as one piece. The handlebar 23 is secured to the handle mount portion 65. The handlebar 23 extends along the width direction of the hull 11.

As shown in FIG. 5, on an upper portion of the tube member 21, stopper walls 66 and 67 are provided. The stopper walls 66 and 67 regulate the range of rotation of the handlebar 23. On an upper portion of the steering shaft 22, a projection portion 68 is provided. When the handlebar 23 rotates to the allowable angle in the clockwise direction, the projection portion 68 abuts against one stopper wall 66. When the handlebar 23 rotates to the allowable angle in the anti-clockwise direction, the projection portion 68 abuts against the other stopper wall 67.

The tube member 21 and the steering shaft 22 can rotate back and forth about the axis of the tilt shaft 55, that is, the first axis X1. The steering shaft 22 can change the inclination angle (tilt angle) forward and backward between a tilt-up position P1 and a tilt-down position P2 with respect to a neutral position N shown in FIG. 4. The tube member 21, the tilt shaft 55 and a lock mechanism 120, which will be described later, and the like constitute a tilt mechanism.

Figure 7:
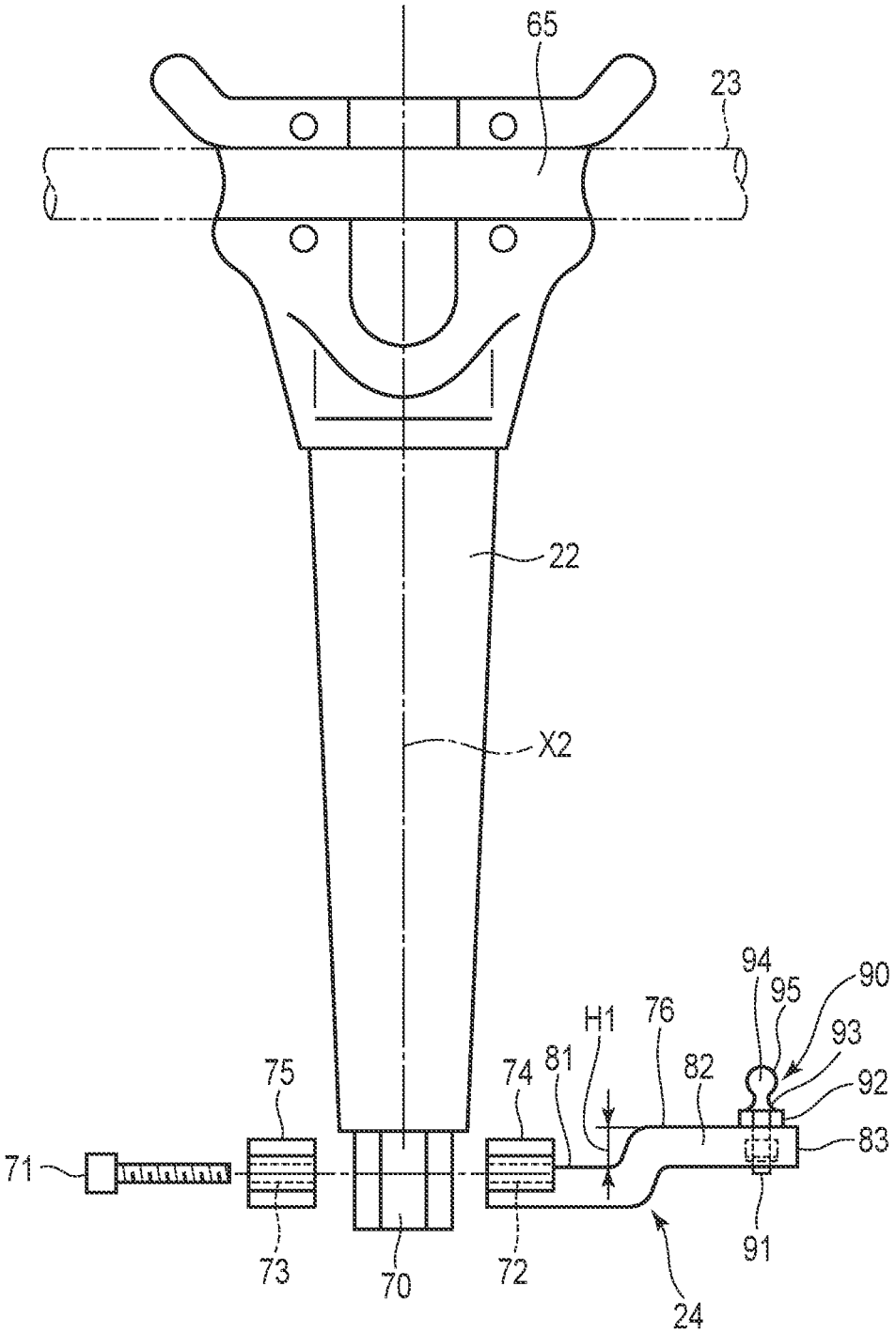
FIG. 7 is a front view of a steering shaft and a steering arm of the steering handle device.
Figure 8:
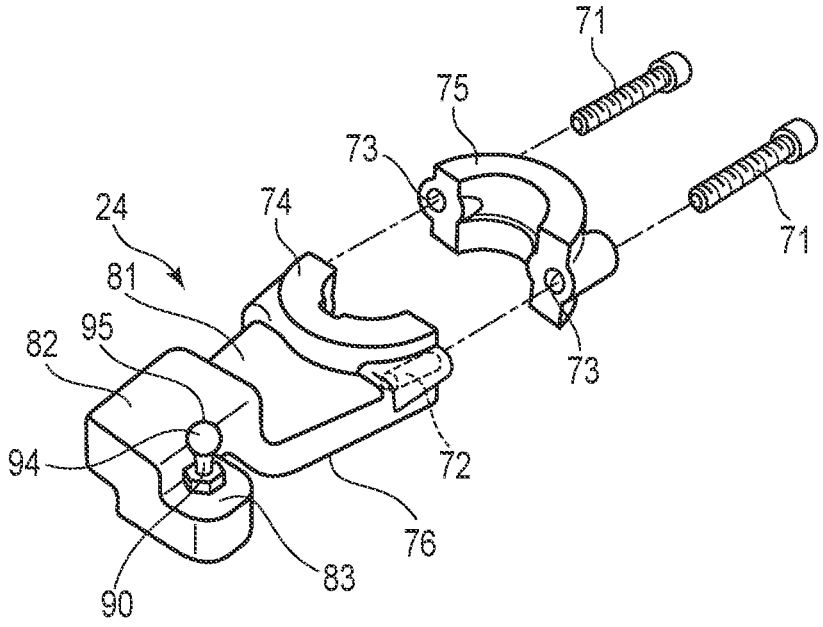
FIG. 8 is an exploded perspective view of the steering arm of the steering handle device.

FIG. 7 is a front view of the steering shaft 22. In a lower end of the steering shaft 22, an arm mount portion 70 is formed. The steering arm 24 is fixed to the arm mount portion 70. The steering arm 24 is fixed to the arm mount portion 70 by, for example, a fixing member 71 such as a bolt. FIG. 8 is an exploded perspective view of the steering arm 24.

As shown in FIGS. 7 and 8, the steering arm 24 includes boss portions 74 and 75 and an extending portion 76. The boss portions 74 and 75 include holes 72 and 73 respectively to which the fixing members 71 are inserted, respectively. The extending portion 76 is integrated with the boss portion 74. The extending portion 76 includes a first portion 81, a second portion 82 and a third portion 83. The first portion 81 extends from the boss portion 74 to the outer side of the housing 20 along the width direction of the hull 11. In the case of the embodiment shown in FIG. 7, the second portion 82 is higher than the first portion 81 by a height H1. But, note that the heights of the first portion 81 and the second portion 82 may be equal to each other. The third portion 83 extends from the second portion 82 to the rear side of the housing 20. In the lower portion of the housing 20, an opening 85 is formed for the extending portion 76 to pass therethrough.

In the third portion 83 of the extending portion 76, a joint member 90 is provided. The joint member 90 includes a base portion 91, a nut portion 92, a support portion 93 and a connection portion 94. The base portion 91 is fixed to the third portion 83 of the extending portion 76. The support portion 93 extends above the nut portion 92. The connection portion 94 is formed on an upper end of the support portion 93. The connection portion 94 includes a rotationally symmetric spherical surface 95 of a shape close to a hemisphere. That is, the connection portion 94 includes a part of a spherical surface. An example of the joint member 90 is an implanted bolt including the connection portion 94. The joint member 90 may be formed to be integrated with the steering arm 24 as one body.

Figure 9:
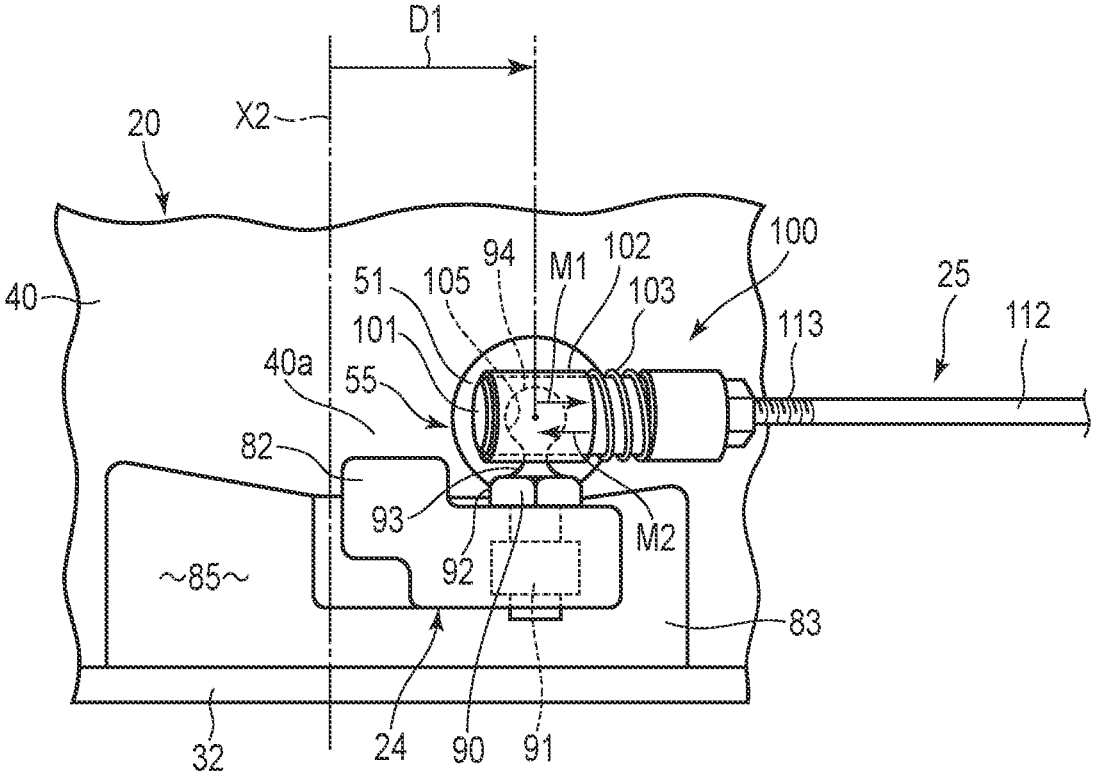
FIG. 9 is a side view of a part of the steering handle device and a joint mechanism of the steering cable.

To the connection portion 94 of the joint member 90, a joint mechanism 100 is connected. The joint mechanism 100 is provided in an end portion of the steering cable 25. FIG. 9 shows a state where the joint mechanism 100 is connected to the connection portion 94 of the joint member 90.

FIG. 5 shows a state where the handlebar 23 and the steering shaft 22 are in a neutral position in the rotation direction. When the steering shaft 22 is in the neutral position in the rotation direction, the connection portion 94 of the joint member 90 is positioned at a position corresponding to the tilt shaft 55 by the support portion 93, as viewed from a lateral direction of the housing 20 as shown in FIG. 4.

As viewed from the front side as shown in FIG. 3, the connection portion 94 of the joint member 90 is positioned between virtual line segments L1 and L2 extending along the horizontal direction. The line segments L1 and L2 are respectively virtual line segments extending from upper and lower surfaces of the tilt shaft 55 in a direction along the first axis X1. Further, as shown in FIG. 4, viewed from the lateral direction, the connection portion 94 of the joint member 90 is placed at a position corresponding to the tilt shaft 55, that is, within a range in which the tilt shaft 55 is extended in a direction along the first axis X1.

As described above, the position of the connection portion 94 of the joint member 90 corresponds to the tilt shaft 55. With this structure, even if the tube member 21 moves between the tilt-up position P1 and the tilt-down position P2, the amount of movement of the connection portion 94 of the joint member 90 can be reduced. Thus, it is possible to suppress the joint mechanism 100 of the steering cable 25 from moving in a swinging manner.

The joint mechanism 100 includes a socket member 101, a cylindrical slide member 102 and a return spring 103. The socket member 101 includes a hole 105 formed therein, to which the connection portion 94 fits. The slide member 102 can move with respect to the socket member 101 in the first direction indicated by the arrow M1 shown in FIG. 9 and in the second direction indicated by the arrow M2 shown in FIG. 9. The return spring 103 urges the slide member 102 in the second direction M2.

When the slide member 102 is moved in the first direction M1 by a finger, the slide member 102 is set in a release position and the hole 105 in the socket member 101 is opened. In this state, the connection portion 94 of the joint member 90 can be inserted to the hole 105 or the connection portion 94 can be pulled out of the hole 105.

When the finger is released from the slide member 102, the slide member 102 moves in the second direction M2 by the elastic force of the return spring 103, thereby placing the slide member 102 in a lock position. When the slide member 102 is in the lock position, the connection portion 94 of the joint member 90 is blocked from exiting the hole 105 by the slide member 102.

As shown in FIG. 4, the steering cable 25 includes an outer tube 110 and an inner cable 111 inserted into the outer tube 110. The inner cable 111 can move relative in the length direction of the outer tube 110. To a distal end of the inner cable 111, a rod member 112 is connected. The socket member 101 is connected to a distal end of a threaded portion 113 formed in the rod member 112.

As shown in FIG. 4, the lock mechanism 120 is provided at the rear portion of the housing 20. The lock mechanism 120 includes a fitting portion 121 for securing the tube member 21 to the housing 20 at a desired tilt angle. The fitting portion 121 includes a plurality of recess portions 122 aligned along an arc around the tilt shaft 55 as the center.

In the housing 20, a lock member 130 is provided. The lock member 130 can be moved to a lock position and an unlock position by an operating part 131. In the lock position, the locking member 130 engages with one recess 122 of the fitting portion 121. In the unlock position, the lock member 130 is released from the recess 122. The lock member 130 engages one recess portion 122 of the recess portions 122 at a position corresponding to the inclination (the tilt angle) of the tube member 21.

As shown in FIG. 4, between a rear surface 21*a* of the tube member 21 and the support member 140 of the housing 20, an assist spring 141 is provided. The assist spring 141 urges the tube member 21 in the direction of the tilt-up position P1 against the weight of the handlebar 23. With this structure, the tilt angle of the tube member 21 can be adjusted by a small force.

As shown in FIG. 9, viewed from the lateral direction of the housing 20, the tilt shaft 55 is located at a position offset from the axis X2 of the steering shaft 22 by a distance D1 in the forward and backward direction (for example, the rear side). On a side wall portion 40 of the housing 20, an offset wall portion 40*a* having a length corresponding to the distance D1 is formed between the axis X2 of the steering shaft 22 and the tilt shaft 55 as viewed from the lateral direction of the housing 20.

FIG. 5 shows a state where the steering shaft 22 is at the neutral position N1 in the direction of rotation and the vessel moves straight ahead. When the steering shaft 22 is at the neutral position N1 in the rotation direction, the connection portion 94 of the joint member 90 is at a position offset from a rotation center X3 of the steering shaft 22 (shown in FIG. 5) to the rear side by the distance D1.

In this state, when the handlebar 23 is rotated from the neutral position N1 in the rotation direction to the direction indicated by arrow A1, the steering arm 24 also rotates in the direction indicated by arrow A1. At this time, the connection portion 94 of the joint member 90 moves from the second neutral position N2 in the direction indicated by arrow B1. With this structure, the steering cable 25 moves in the direction indicated by arrow C1. In this manner, the direction of the water jet nozzle 14 is changed.

As the handlebar 23 rotates from the neutral position N1 in the rotation direction, to the direction indicated by arrow A2 (shown in FIG. 5), the steering arm 24 as well rotates in the direction indicated by arrow A2. At this time, the connection portion 94 of the joint member 90 moves from the second neutral position N2 in the direction indicated by arrow B2. Thus, the steering cable 25 moves in the direction indicated by arrow C2. In this manner, the direction of the water jet nozzle 14 is changed.

As described above, the steering arm 24 rotates forward (in the direction indicated by arrow A1) and backward (in the direction indicated by arrow A2) with respect to the first neutral position N1 shown in FIG. 5. The connection portion 94 of this embodiment is placed at a position offset by the distance D1 to the rear side with respect to the rotation center X2 of the steering shaft 22.

Therefore, the connection portion 94 rotates forward (in the direction indicated by arrow B) and backward (in the direction indicated by arrow B2) with respect to a second neutral position N2 located on the rear side of the first neutral position N1 in the rotation direction of the steering shaft 22. The line segment L3 shown in FIG. 5 extends in the back-and-forth direction of the hull 11. The steering cable 25 can be placed to extend from the connection portion 94 to a diagonally backward direction of the hull 11 at an angle θ2 with respect to the line segment L3.

As shown in FIG. 2, the engine 12 may be located behind the steering handle device 13. In such a case, if the steering cable 25 extends directly behind the steering arm 24, the steering cable 25 may interfere with the engine 12. By contrast, according to the steering handle device 13 of this embodiment, the steering cable 25 extends toward the direction of the engine 12 at an angle θ2 with respect to the line segment L3 along the back-and-forth direction of the hull 11 (see FIG. 5). With this structure, it is possible to position the steering cable 25 connected to the steering arm 24 so as to avoid interference with the engine 12.

The steering shaft 22 is made from substantially a single member which does not include a universal joint in the middle thereof along its length direction. The upper portion of the steering shaft 22 is supported by the upper support portion 60 of the tube member 21. The lower portion of the steering shaft 22 is supported by the lower support portion 61 of the tube member 21 in this manner, it is possible to avoid the span supporting the steering shaft 22 from becoming small, and thus the support strength can be increased.

In the steering handle device 13 of this embodiment, the flange 32 on the lower surface of the housing 20 is fixed to the outer mount surface 33 of the hull 11. That is, the housing 20, the tube member 21, the steering shaft 22, the steering arm 24, the joint member 90 and the like, which is the entire steering handle device 13, are placed on the outer side of the hull 11. With this structure, there is no need to form an opening in the hull 11 to accommodate the lower portion of the steering handle device 13 in the hull 11. Here, although it is necessary to provide holes in the hull 11 for the fixing member 34 and the steering cable 25 to pass through, such holes are so small that waterproofing measures are not difficult.

Needless to say, when implementing the present invention, the specific shapes and configurations of the housing, tube member, steering shaft, steering arm, joint member and the like, which constitute the steering handle device, can be changed in various ways. Further, the invention can as well be applied to steering handle devices of small vessels other than watercrafts.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A steering handle device for a vessel, comprising:

a housing including a space therein;

a tube member inserted into the space of the housing and supported by a tilt shaft having a first axis about which the tube member is rotatable back and forth with respect to the housing;

a steering shaft to which a handlebar is attached at an upper portion thereof, the steering shaft having a second axis extending in a length direction, being inserted into the tube member, and being rotatable about the second axis with respect to the tube member;

a steering arm provided at a lower end of the steering shaft and including an extending portion, the extending portion including a first portion and a second portion each extending toward an outer side of the housing, the second portion being located farther outward than the first portion, and the extending portion further including a third portion extending from an outer end of the second portion to a rear side of the housing; and a joint member provided on a rear end side of the third portion of the steering arm, the joint member including:

a connection portion to which a joint mechanism of a steering cable is connected; and a support portion supports the connection portion within a range in which the tilt shaft is extended in a direction along the first axis in a state in which the steering shaft is in a neutral position along a rotation direction thereof.

2. The steering handle device according to claim 1, wherein:

a part of the connection portion has a rotationally symmetric shape of a spherical surface, and the connection portion is provided in the range in which the tilt shaft is extended in the direction along the first axis, in the state in which the steering shaft is in the neutral position along the rotation direction thereof.

3. The steering handle device according to claim 2, further comprising:

an offset wall comprising a side wall of the housing between the second axis and the tilt shaft as viewed from a lateral direction of the housing, the offset wall shifting a position of the tilt shaft in a forward/backward direction with respect to the second axis.

4. The steering handle device according to claim 1, wherein the housing includes a flange portion on a lower portion thereof, which is fixed to a mount surface on an outer side of a hull in a state where the housing, the tube member, the steering shaft, the steering arm, and the joint member are each positioned on the outer side of the hull.

* * * * *